US006101640A

United States Patent [19]

Brewer et al.

[11] Patent Number: 6,101,640

[45] Date of Patent: Aug. 15, 2000

[54] REMOVABLE TOILET SEAT AND TOILET SEAT CONNECTOR

[76] Inventors: Barbara J. Brewer, 340 Carrie Dr.; Mary P. Bartlett, 1750 Centennial Dr., both of Mountain Home, Id. 83647

[21] Appl. No.: 09/034,103

[22] Filed: Mar. 3, 1998

Related U.S. Application Data

[63] Continuation-in-part of application No. 08/669,030, Jun. 17, 1996, abandoned.

[51] Int. Cl.[7] ..... A47K 13/12

[52] U.S. Cl. ..... 4/236; 411/48; 411/60

[58] Field of Search ..... 4/234, 236; 411/41, 411/46, 48, 60

[56] References Cited

U.S. PATENT DOCUMENTS

| | | | |
|---|---|---|---|
| 2,004,023 | 6/1935 | Uffen | 4/240 |
| 3,055,015 | 9/1962 | Silverman | 4/240 |
| 3,063,063 | 11/1962 | Brooks | 4/236 |
| 3,613,130 | 10/1971 | Sansone | 4/240 |
| 4,319,365 | 3/1982 | Bemis et al. | 4/236 |
| 4,917,552 | 4/1990 | Crawford | 411/60 X |
| 5,457,824 | 10/1995 | Reed | 3/234 |

FOREIGN PATENT DOCUMENTS

| | | | |
|---|---|---|---|
| 0047504 | 8/1976 | Australia | 411/60 |
| 9015565 | 12/1990 | WIPO | 4/236 |
| 9401033 | 1/1994 | WIPO | 4/236 |

*Primary Examiner*—Charles E. Phillips
*Attorney, Agent, or Firm*—Robert L. Shaver; Frank J. Dykas

[57] ABSTRACT

A removable toilet seat assembly is provided having a hinge assembly wherein one or more pins extend downwardly through, and snugly interfit within collars, which are themselves inserted and firmly attached by a locking ring within the conventional toilet seat hinge attachment holes found in the rearwardly extending ledge of a toilet bowl. Both the collar and the hinge pins can be installed and removed without the use of tools, for easy cleaning of the toilet seat and the toilet top.

1 Claim, 7 Drawing Sheets

REMOVABLE TOILET SEAT AND TOILET SEAT CONNECTOR

This application is a continuation-in-part of application Ser. No. 08/669,030 filed Jun. 17, 1996, now abandoned entitled Removable Tiolet Seat

BACKGROUND OF THE INVENTION

1. Technical Field

This invention generally relates to toilet seats, and more particularly to a removable toilet seat and connector.

2. Background

The typical prior art toilet has an upstanding bowl, usually made of porcelain, has a generally oval shape, and an extending back or rearwardly facing support ledge to which a water tank is bolted. The prior art toilet seat has a round, usually molded seat which is of conforming shape to the bowl opening and rests atop the bowl. It is interconnected by a hinge assembly to a liftable cover which rests against the front face of the upstanding water tank. These two pieces are hinged, usually by means of a pair of hinges to a hinge body which is bolted to the toilet bowl through hinge attachment holes in the rear ledge of the bowl. The bolts extend through the support ledge and are firmly fixed in place by means of nuts or combinations of lock washers and nuts.

In the prior art, it is intended that the toilet seat assembly be permanently affixed to the top of the bowl.

The problem resulting from the permanent fixture of the toilet seat is that in order to thoroughly clean the toilet, you have to clean around the hinge assembly and under the raised seat and cover. People find the objectionable task of cleaning a toilet even more objectionable when they have to reach underneath the upraised seat and clean around the attached hinges. Without being able to remove the seat, it is also very difficult to thoroughly sanitize the toilet top.

Accordingly, it is an object of the present invention to provide a toilet seat cover assembly which can be quickly and easily removed for purposes of cleaning both the seat, its hinges, and the toilet bowl, without the use of tools.

It is a further object to provide a quick attachment device for attaching and removing the toilet seat without the use of tools.

DISCLOSURE OF INVENTION

These and other objects are achieved in a removable toilet seat assembly and connectors for a conventional toilet seat, formed of a conventional toilet seat and toilet seat cover, which are both hingedly attached by means of conventional hinges to a hinge body. Extending downwardly from the hinge body are hinge pins, which, in one embodiment, are formed of metal and are screwed firmly into the hinge body. The hinge pins are designed to snugly interfit within pin receiving holes formed within pin receiving collars.

The pin receiving collars are provided with retaining flange and configured in size to interfit through the conventional hinge attachment holes found in the rearwardly extending support ledge of the conventional prior art toilet. Nuts are used to draw down the retaining flanges of the pin receiving collars to firmly place the pin receiving collars in a fixed location.

The pin receiving collars are first affixed to the support ledge and then the hinge pins extending down from the hinge body are inserted into the pin receiving holes to fix the toilet seat assembly relative to the toilet.

In a second embodiment, a plurality of extending pin shafts are used in lieu of the pin receiving collars. Each extending pin shaft is fixed in place within the toilet seat attachment holes formed in the rearwardly extending support ledge of the conventional toilet bowl body by drawing the extending pin flanges tightly against the top surface of the support ledge by tightening a nut threaded to the shaft and extending below the support ledge. Extending up from these extending pin shafts are extending pin posts which interfit within pin receiving slots formed in the hinge body.

In another embodiment of the invention, the invention is a removable toilet seat for use with a conventional toilet of the type having a bowl, a toilet seat support surface, and toilet seat hinge attachment holes. This embodiment of the invention includes a collar which is configured to receive the hinge pin and secure the hinge pin in place. The collar is threadless, and has expanding members which allow it to radially expand. It is configured for insertion and retention within the toilet seat hinge attachment holes on the toilet seat support surface. The collar is thus configured to receive and removably hold the hinge pin. It includes a flange and a body which is a tubular section and four expanding members. These expanding members have a larger diameter when expanded by the insertion of the hinge pin than they do when not expanded. When the hinge pin is inserted into the collar, the expanding members are placed in an expanded position. When the hinge pin is not in the expanding collar, the expanding members are in a non-expanded position. This version of the device includes a toilet seat which has an opening and is configured to rest upon the toilet seat support surface. It also includes a hinge assembly which is pivotally attached to the toilet seat. The hinge assembly has one or more hinge pins, generally utilizing a pair of hinge pins, each with a grip plate, a shoulder, a tapering shaft, and an expansion head. These hinge pins are configured for removable insertion without tools into the collar described above. The hinge pin is designed to expand the four expanding members of the collar. The collar can also be described as a pin receiving and pin securing collar. This version of this invention also includes a circular locking ring whose inside diameter is greater than the outside diameter of the collar body. It fits on the pin receiving and securing collar adjacent the flange. When the hinge pin is inserted into the collar, thus expanding the expanding members of the collar, the inside diameter of the circular locking ring is smaller than the diameter of the diameter formed by the four expanded members in their expanded position.

Still another version of the invention is a connector for removably attaching a toilet seat hinge assembly to a toilet seat. The toilet seat is of the type having an opening, and configured to rest upon a toilet seat support surface, which itself has toilet seat hinge attachment holes. The invention includes a collar which has a radial flange at one end joined to a cylindrical body. The cylindrical body includes a tubular section attached to four expanding members which each have an expansion head securing tab, or gripping ridge. The pin receiving and securing collar is configured for insertion and retention within the toilet seat hinge attachment holes. It is also configured to receive and removably hold a hinge pin. When the hinge pin is inserted into the collar, the expanding members are spread apart and they have an outside diameter which is greater in this expanded position than when the hinge pin is not inserted. Part of this version of the invention includes one or more hinge pins, generally utilized in pairs, each of which has a grip plate, a shoulder, a tapering shaft, and an expansion head on one end of the hinge pin. The hinge pin is configured for removable insertion without tools into the pin receiving and pin securing collar. When inserted into this collar, the expansion head is configured to expand the four expanding members of the collar. The invention of this version also includes a circular locking ring, which has an inside diameter which is slightly larger than the outside diameter of the body of the collar, and the four expanding members of the collar when they are in a non-expanded position. When the four expanding members are in an expanded position, the inside diameter of the circular locking ring is smaller than the diameter formed by the four expanding members when expanded.

BEST MODE FOR CARRYING OUT INVENTION

Figure 1:
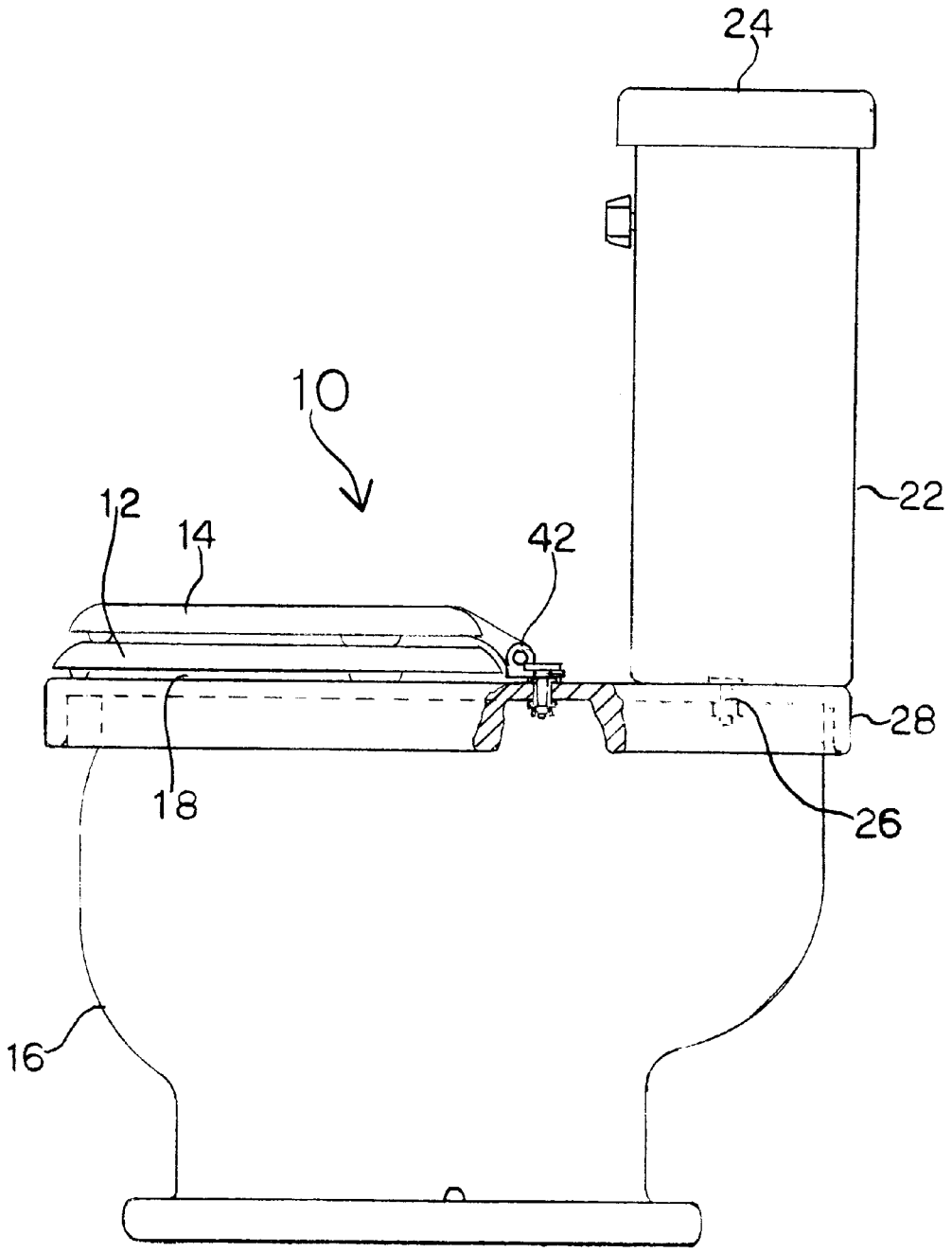
FIG. 1 is a sectional side view of a toilet showing a first embodiment of the removable toilet seat.
Figure 2:
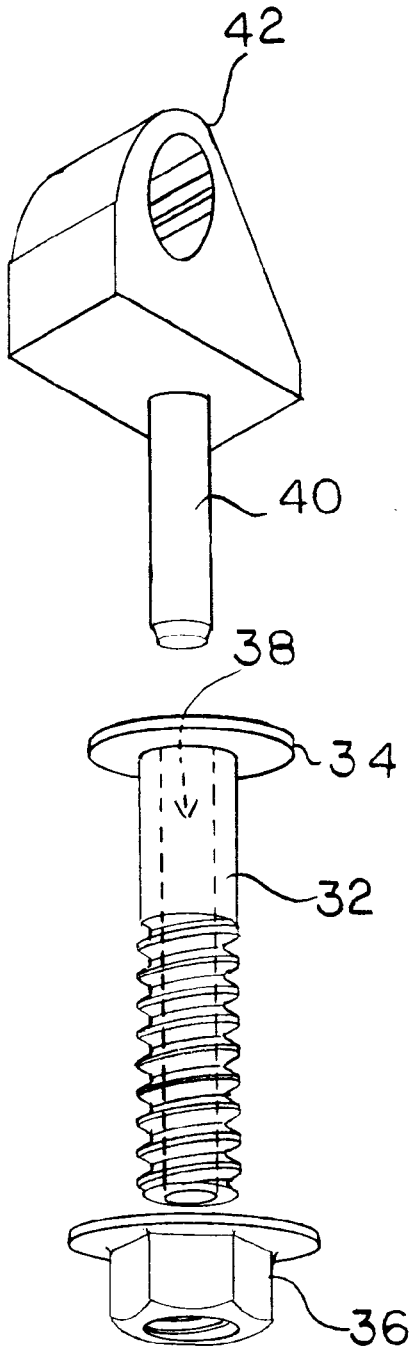
FIG. 2 is a perspective representational view of the pin and collar assembly of the first embodiment of the removable toilet seat.

Referring to FIGS. 1 and 2, the first embodiment of the removable toilet seat assembly 10 is shown attached to toilet bowl 16. In this preferred embodiment, the removable toilet seat assembly 10 has seat 12 which rests upon toilet seat support surface 18 of toilet bowl 16. Toilet bowl 16 has formed integral with it rearwardly extending support ledge 28. Water tank 22 is attached by means of conventional bolts to water tank attachment holes 26 which are preformed in support ledge 28. Water tank 22 is, of course, covered with the standard prior art water tank cover 24.

Removable toilet seat assembly 10 is formed of toilet seat 12 and toilet seat cover 14. Both are hingedly attached by means of conventional hinges to hinge body 42. Extending downwardly from hinge body 42 is hinge pin 40. In the preferred embodiment, hinge pin 40 is formed of metal and screwed firmly into hinge body 42. Hinge pin 40 is designed to snugly interfit within pin receiving hole 38 and formed in pin receiving collar 32. Pin receiving collar 32 is provided with retaining flange 34 and is configured in size to interfit through hinge attachment holes 20 in support ledge 28. Nut 36 is provided to draw down retaining flange 34 against the top surface of support ledge 28 to firmly place pin receiving collar 32 in a fixed location.

In this first preferred embodiment, pin receiving collars 32 are first firmly affixed to support ledge 28 of toilet bowl 16, then hinge pins 40 are inserted into pin receiving hole 38 to fix the removable toilet seat assembly 10 in place on the toilet. Toilet cover 14 and seat 12 can then be raised and lowered in a conventional and well-known manner, as necessary for proper use of the toilet.

Figure 3:
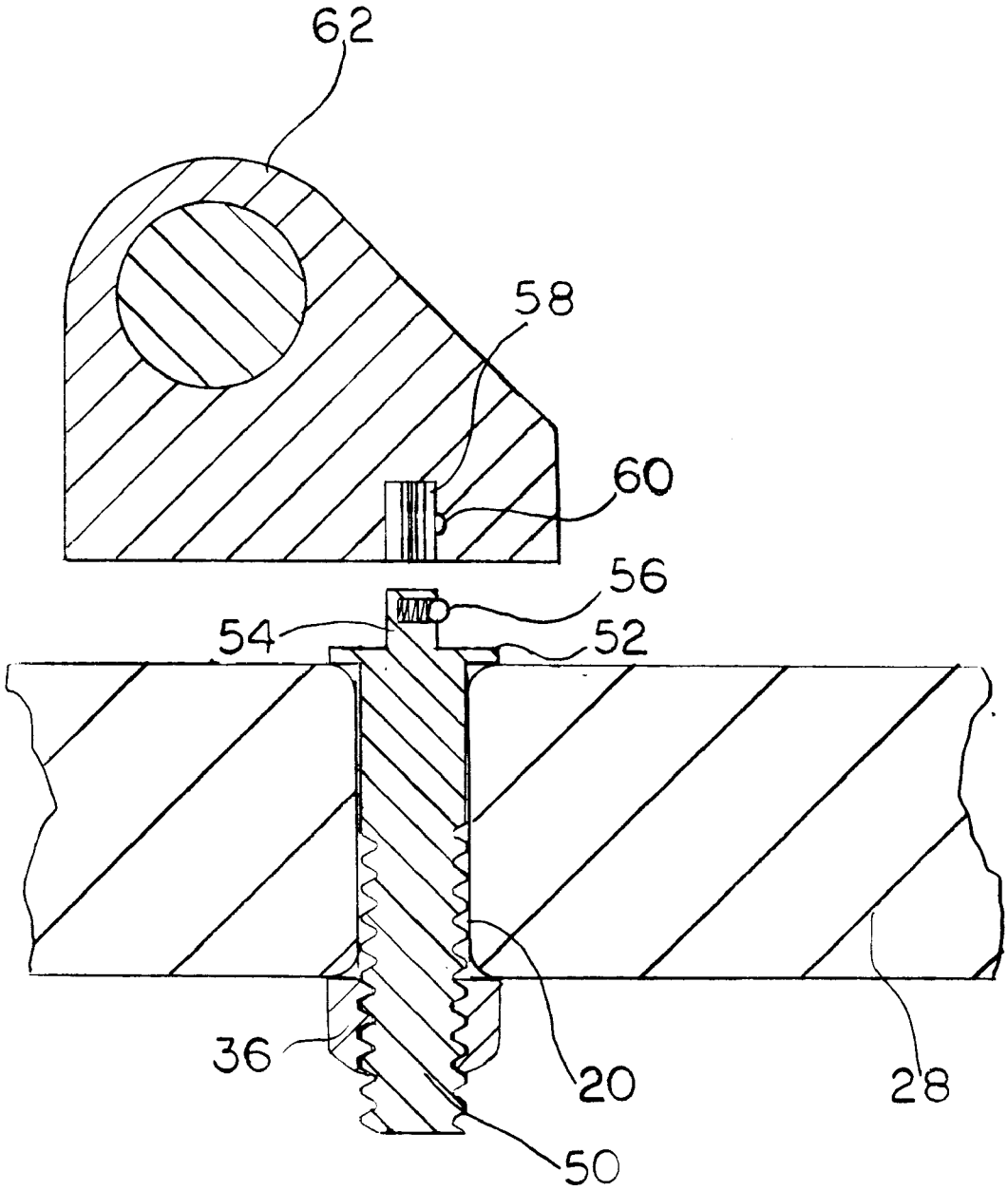
FIG. 3 is a sectional side view of a second embodiment of the removable toilet seat.

A second preferred embodiment is shown in FIG. 3. In this embodiment, extending pin shaft 50 is used in lieu of pin receiving collar 32. It is fixed in place within toilet seat hinge attachment hole 20 formed in support ledge 28 by drawing extending pin flange 52 tightly against the top surface of support ledge 28 by tightening nut 36. Extending up from extending pin shaft 50, is extending pin post 54. Extending pin post 54 is provided with spring-loaded detent ball 56. Extending pin post 54 with its detent ball 56 are designed to interfit within pin receiving slot 58 formed in hinge body 62 with detent ball 56 locked into detent 60. To remove the toilet seal, one merely pulls up on the toilet seat to release hinge body 62 from pin receiving slot 58.

Figure 4:
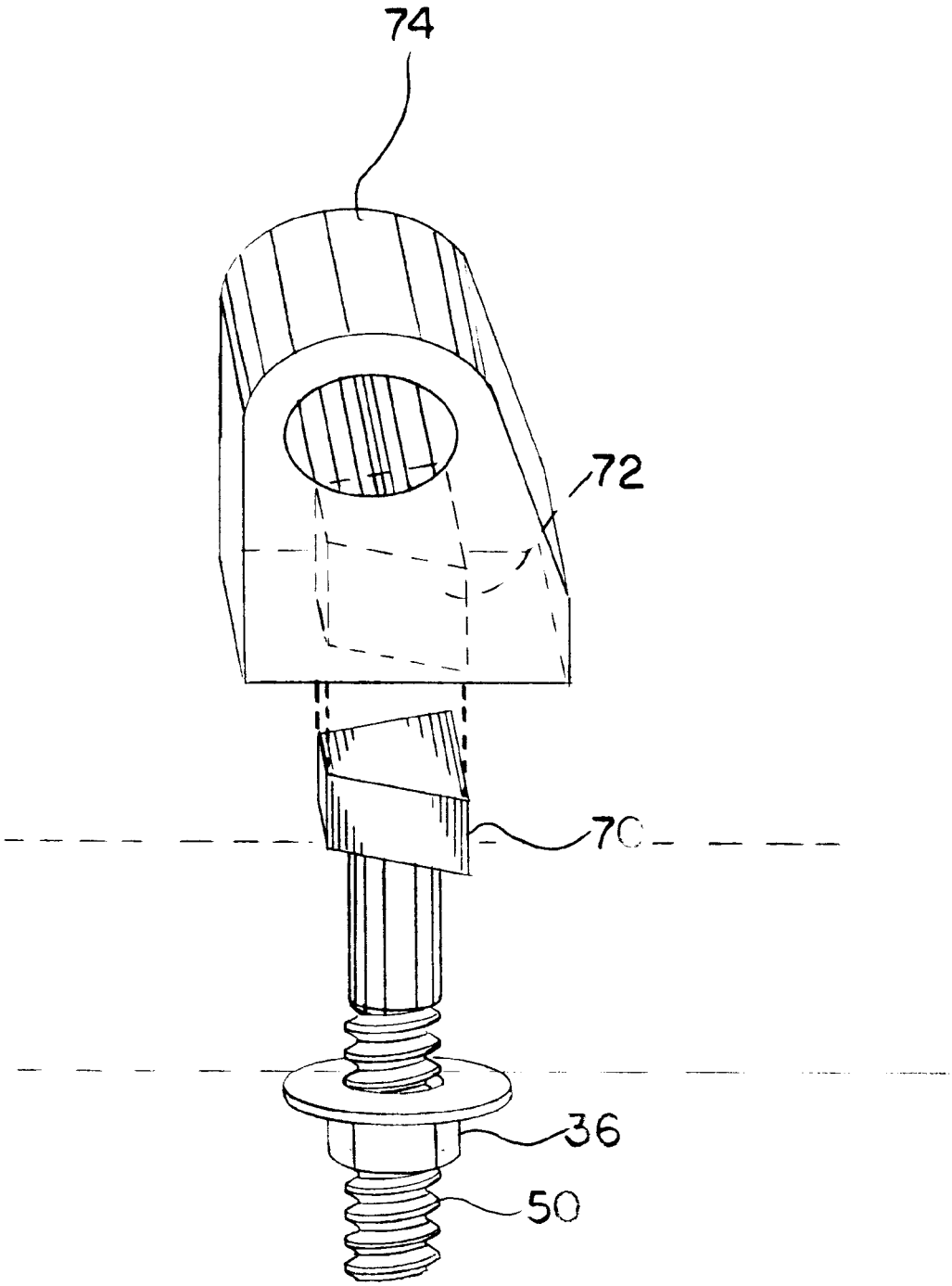
FIG. 4 is a perspective representational view of a third embodiment of the removable toilet seat hinge assembly.

In FIG. 4 there is shown a third preferred embodiment. This is similar to a second preferred embodiment of FIG. 3, except that instead of extending cylindrical pin post 54, there is provided an extending pin post 70 of trapezoidal shape, such as to provide greater lateral stability to hinge body 74 when trapezoidal pin post 70 is inserted within conforming slot 72.

In FIGS. 5 through 8 is shown a fourth preferred embodiment. This embodiment is designated as removable toilet seat connector assembly 80. The removable toilet seat connector assembly 80 includes a hinge pin 82, a hinge mount 84, pin receiving and securing collar 86, and locking ring 88.

Figure 5:
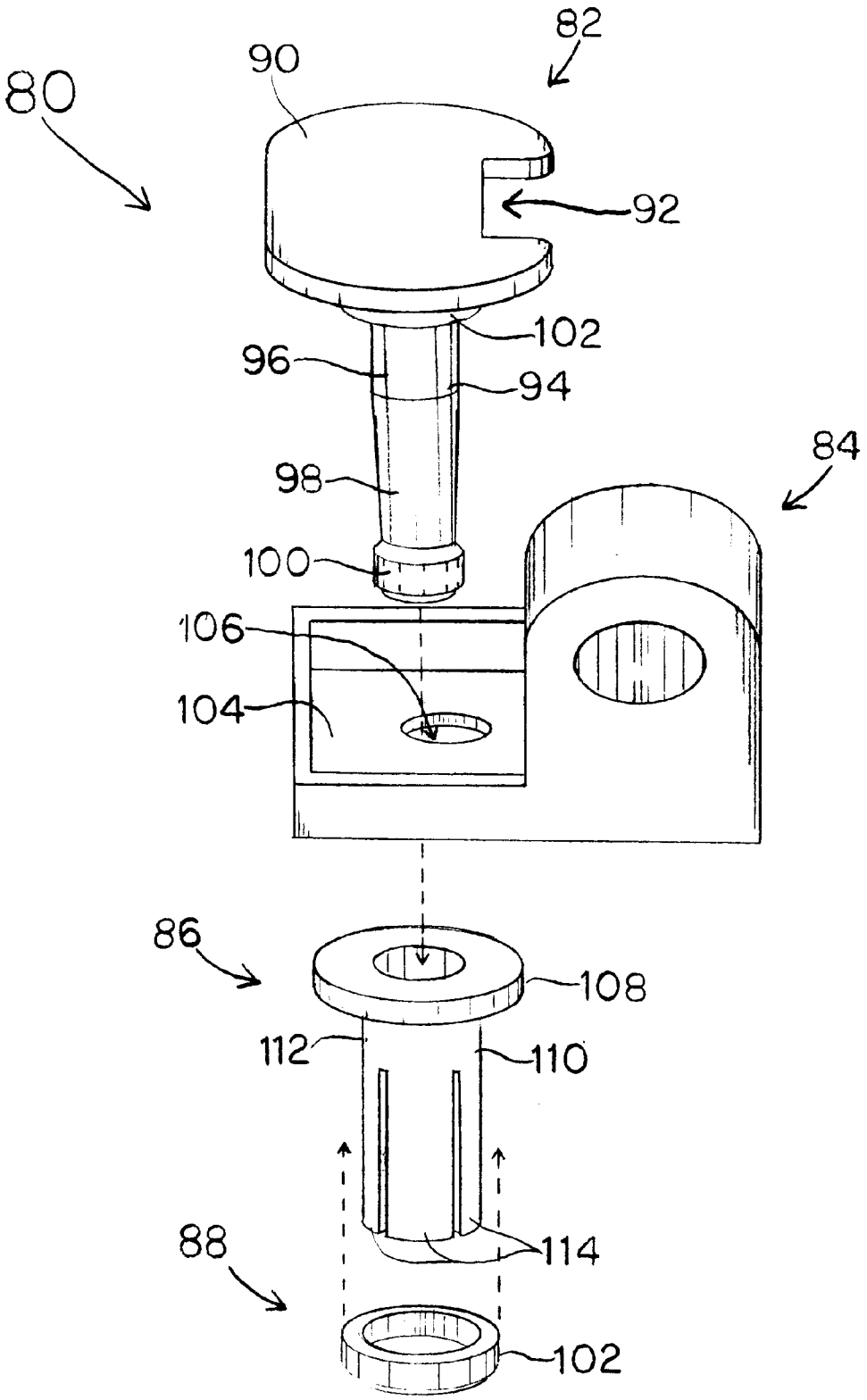
FIG. 5 is an exploded view of a fourth embodiment of the removable toilet seat hinge assembly.
Figure 6:
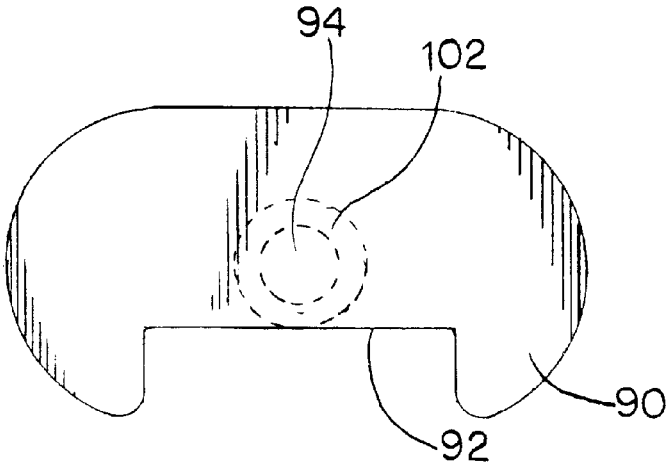
FIG. 6 is a top view of a hinge pin.

Hinge pin 82 includes a grip plate 90, which is generally oval in shape, with an indented region 92 on one side, as shown in FIG. 5. On one side of grip plate 90 is attached a hinge pin shaft 94. Hinge pin shaft 94 has a cylindrical section 96 and a tapered section 98. On the hinge pin shaft 94 adjacent to the grip plate 90 is located a collar 102, which is cylindrical in shape. At the end of the tapered section 98 is mounted an enlarged region called an expansion head 100. Hinge pin 82 will typically be made from a plastic material such as nylon, polyethylene, polypropylene, silicone, or other moldable material.

Hinge mount 84 is a bracket through which a shaft is extended and on which shaft the toilet seat and the toilet seat lid are mounted. Hinge mount 84 is identical in shape to prior art hinge mounts on prior art toilet seat assemblies. It includes a bolt box 104 which contains a bolt hole 106 through which the prior art mounting bolt is passed and bolted on to the toilet support surface 18.

The pin receiving and securing collar 86 includes a flange 108 and a body 110. The body is generally cylindrical, and includes a tubular section 112 and four expanding members 114. When seen in cross-section as in FIG. 7, the expanding members 114 are seen to have a gripping ridge 116 on their inside surface.

The collar 102 is a cylindrical ring whose internal diameter forms a close fit over the tubular section 112 of the body 110 when the expanding members 114 are not expanded.

Figure 7:
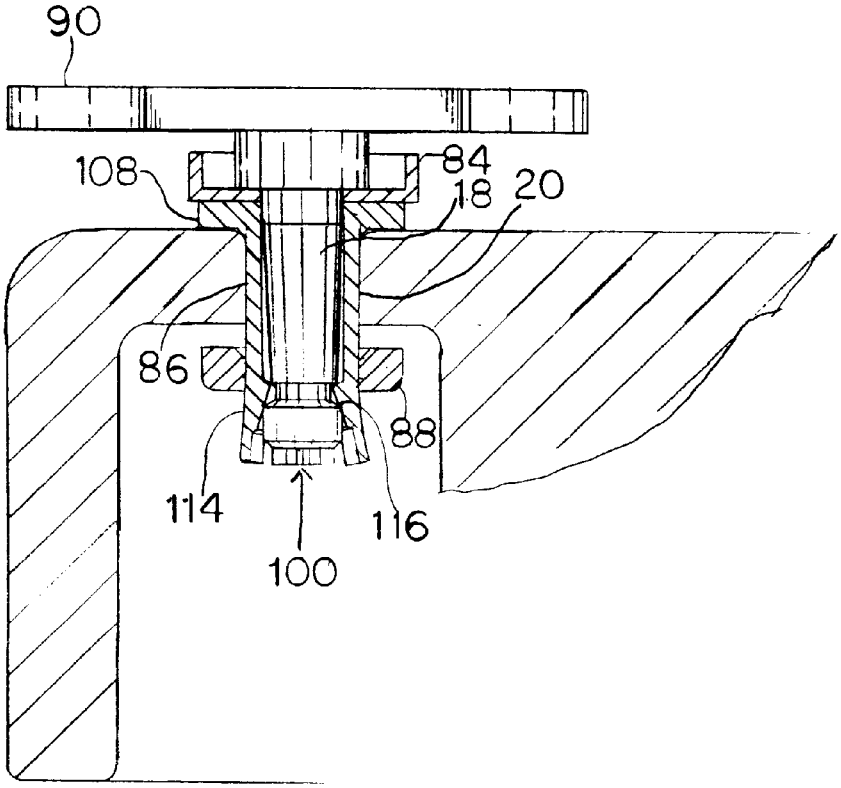
FIG. 7 is a side cross-sectional view of a removable toilet seat hinge assembly with the hinge pin, collar and locking ring in place.

To use the removable toilet seat connector assembly 80, the pin receiving and securing collar 86 is first inserted into the hinge attachment holes 20 of the toilet seat, as shown in FIG. 7. The pin receiving and securing collar 86 is inserted until the flange 108 is firmly in contact with the toilet seat support surface 18. Next, the locking ring 88 is slipped over the ends of the expanding members 114 and moved towards the flange 108 of the pin receiving and securing collar 86. In the non-expanded position, the expanding members 114 form a generally tube-shaped structure with an outside diameter which is slightly less than that of the inside diameter of the locking ring 88.

With the pin receiving and securing collar 86 in place and the locking ring 88 in place underneath the toilet seat support surface 18, the toilet seat 12 and the hinge mount 84 attached to it are moved into place so that the bolt hole 106 and the bolt box 104 are over the body 110 of the pin receiving and securing collar 86. Next, the hinge pin shaft 94 is pressed through the bolt hole 106 and through the tube formed by the cylindrical body 110 of the pin receiving and securing collar. As the expansion head 100 of the hinge pin 82 extends through the body 110, it contacts expanding members 114 and forces them apart. When the expansion head 100 extends past the gripping ridge 116, the expanding members are pushed to a position so that their outside diameter is larger than the inside diameter of locking ring 88. In this position, all members of the assembly, including the toilet seat, are locked together. This assembly occurs without the use of tools and without the need to screw a nut on a bolt. Since this toilet seat and the connectors for holding it in place are easily assembled by hand, they may also be easily disassembled by hand for ease in cleaning the toilet seat support surface. While removed, the toilet seat assembly itself can be sterilized by cleaning solutions, or even in a dishwasher.

Figure 8:
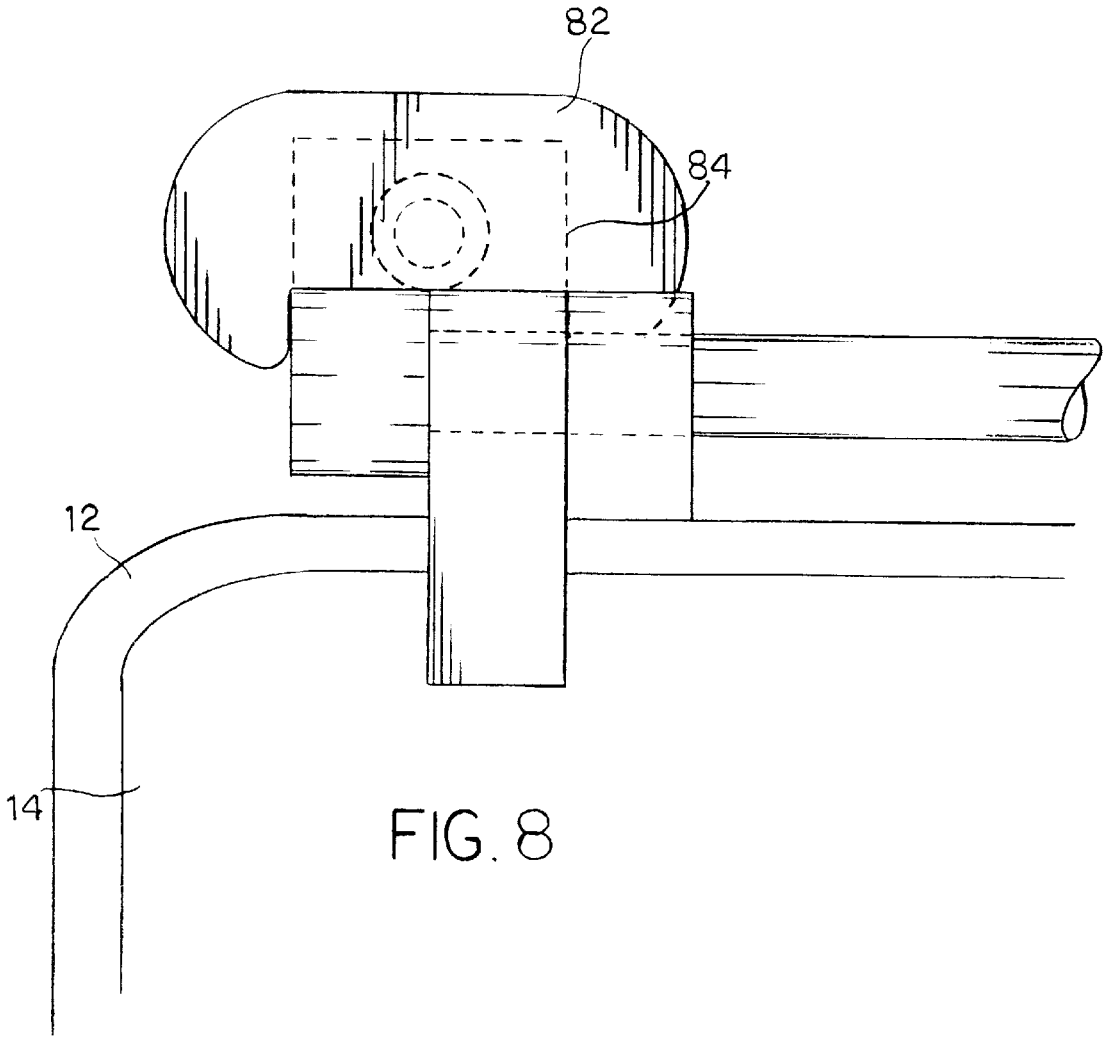
FIG. 8 is a top view of a removable toilet seat hinge assembly showing the seat hinge and the hinge pin grip plate.

FIG. 8 is a top view of the removable toilet seat or removable toilet seat connectors showing the hinge pin 82 mounted over the hinge mount 84 and holding down the toilet seat 12 and the toilet seat cover 14.

While there is shown and described the present preferred embodiments of the invention, it is to be distinctly understood that this invention is not limited thereto but may be variously embodied to practice within the scope of the following claims.

What is claimed is:

1. A removable toilet seat and removable toilet seat connector assembly, for use with a toilet of the type having a bowl, a toilet seat support surface and toilet seat hinge attachment holes, said removable toilet seat and connector assembly comprising:

a toilet seat having an opening therethrough and configured to rest upon said toilet seat support surface;

at least one threadless and radially expanding pin receiving and pin securing collar having a flange joined to an end of a cylindrical body, said body further comprising a tubular section having a plurality of expanding members which together have an inside and outside diameter and which have an expanded position and a non-expanded position, with each expanding member having a gripping ridge located on said inside diameter for interaction with an expansion head, with said cylindrical body being configured for insertion and retention within said toilet seat hinge attachment holes, said pin receiving and pin securing collar configured to be locked into place in said toilet seat hinge attachment holes by a locking ring and without use of tools, and to receive and removably hold a hinge pin which also causes said expanding members to be pressed into said expanded position;

a circular locking ring with an inside diameter for insertion on said pin receiving and pin securing collar, configured so that said inside diameter of said circular locking ring fits on said pin receiving and securing collar adjacent said flange, and is smaller than said diameter of said four expanding members when said four expanding members are in said expanded position from an insertion of said expansion head; and a hinge mount pivotally attached to said toilet seat, said hinge mount including a hinge pin with a grip plate, a shoulder, a tapering shaft, and an expansion head on an end of said shaft, said shaft configured for insertion and removal without tools into said pin receiving and pin securing collar, and configured to expand said expanding members of said pin receiving and pin securing collar and to be locked in place by cooperation of said gripping ridge of said pin receiving and securing collar and said expansion head.

* * * * *